US005240388A

United States Patent [19]

Matsumoto et al.

[11] Patent Number: 5,240,388

[45] Date of Patent: Aug. 31, 1993

[54] SCROLL TYPE COMPRESSOR WITH VARIABLE DISPLACEMENT MECHANISM

[75] Inventors: Takayuki Matsumoto, Gunma; Yasuhiro Tsukagoshi, Ota, both of Japan

[73] Assignee: Sanden Corporation, Gunma, Japan

[21] Appl. No.: 852,766

[22] Filed: Mar. 16, 1992

[30] Foreign Application Priority Data

Mar. 15, 1991 [JP] Japan ..... 3-074434

[51] Int. Cl.[5] ..... F04C 21/00

[52] U.S. Cl. ..... 417/299; 417/310

[58] Field of Search ..... 417/299, 310; 418/55.1

[56] References Cited

U.S. PATENT DOCUMENTS 3,759,057 9/1973 English et al. .
4,382,370 5/1983 Suefuji et al. .
4,459,817 7/1984 Inagaki et al. .
4,468,178 8/1984 Hiraga et al. .
4,505,651 3/1985 Terauchi et al. .
4,557,670 12/1985 Inagaki et al. .
4,642,034 2/1987 Terauchi .
4,717,314 1/1988 Sato et al. ..... 417/310
4,744,733 5/1988 Terauchi et al. .
4,904,164 2/1990 Mabe et al. .
4,940,395 7/1990 Yamamoto et al. ..... 417/310
5,059,098 10/1991 Suzuki et al. ..... 417/299 X

FOREIGN PATENT DOCUMENTS 0144169 11/1984 European Pat. Off. .
60-101295 of 1985 Japan .

*Primary Examiner*—Richard E. Gluck
*Attorney, Agent, or Firm*—Baker & Botts

[57] ABSTRACT

A variable displacement mechanism for a scroll type compressor opens and closes a communication path between the suction chamber and a pair of intermediately located sealed spaces. The variable displacement mechanism includes a piston valve member slidably disposed within a cavity. The piston valve selectively opens and closes the communication path between the suction chamber and intermediately located sealed spaces. A conduit permanently links the discharge chamber to the upper end surface of the piston valve so that, even when the communication path is established, the upper end surface of the piston valve is constantly exposed to discharge pressure.

25 Claims, 3 Drawing Sheets

SCROLL TYPE COMPRESSOR WITH VARIABLE DISPLACEMENT MECHANISM

BACKGROUND OF THE INVENTION

1. Field of the Invention

The present invention relates to a scroll type compressor, and more particularly, to a scroll type compressor with a variable displacement mechanism.

2. Description of the Prior Art

A compressor in an automobile air conditioning system is driven by the automobile engine through an electromagnetic clutch. Unless the compressor has a variable displacement mechanism, when the engine rotates at a high rate, the compressor will be driven at a high rate as well and the operating capacity of the compressor may be larger than necessary. Therefore, in order to ensure proper functioning of the compressor, the electromagnetic clutch must be turned on and off frequently. This frequent control of the electromagnetic clutch causes a large change in the load on the engine, thereby reducing the speed and acceleration performance of the automobile.

One solution to above problem is to provide a scroll type compressor with a variable displacement mechanism for varying the compression ratio. A scroll type compressor with a variable displacement mechanism is disclosed in U.S. Pat. No. 4,717,314 to Sato et al., which is hereby incorporated by reference. The variable displacement mechanism includes a control device which controls an opening and closing of a communication path between the suction chamber and a pair of intermediately located sealed spaces defined by the spiral elements. The control device includes a cylinder, a part of which defines the communication path, and a piston member which is slidably disposed within the cylinder. The control device further includes an electromagnetic valve which is magnetized and demagnetized in response to an external ON-OFF signal to introduce discharge pressure to an upper surface of the piston member. By selectively introducing discharge pressure to the upper surface of the piston member, the piston member slides within the cylinder to control the opening and closing of the communication path.

However, the variable displacement mechanism of U.S. Pat. No. 4,717,314, in order to generate the external ON-OFF signal, requires an electromagnetic valve and a device for processing a signal representing an operational condition of the automobile air conditioning system (e.g., temperature of the air leaving the evaporator). The requirement of an electromagnetic valve and the associated signal processing device increases the number of component parts of the variable displacement mechanism. Therefore, the manufacturing cost of the compressor is increased.

Alternatively, a variable displacement mechanism for a scroll type compressor can operate without the provision of an electromagnetic valve. For example, U.S. Pat. No. 4,940,395, which is hereby incorporated by reference discloses a variable displacement mechanism for a scroll type compressor which relies on the piston's reciprocation to open and close a communication path between intermediately located fluid pockets and the suction chamber. The '395 piston is hollowed out and includes a suction responsive bellows valve placed therein. When the pressure in the bellows overcomes the suction pressure in the interior of the piston, the bellows expands, and a needle-ball type valve sealing the discharge pressure at the top of the piston is unseated. Consequently, the discharge pressure acting on the top of the piston is exhausted to the suction chamber, and the piston, biased by the restoring force of coil spring, reciprocates to open the communication path between the intermediate fluid pockets and the suction chamber.

While disposing with the need for an electromagnetic valve, the '395 variable displacement mechanism still requires a piston whose reciprocal movement is dependent upon a bellows disposed therein. Therefore, the '395 piston valve member is somewhat complicated.

Other scroll type compressors having variable displacement mechanisms include U.S. Pat. Nos. 4,505,651, 4,642,034, 4,673,340, 4,744,733, and 4,904,164, which are all hereby incorporated by reference.

SUMMARY OF THE INVENTION

Accordingly it is an object of the present invention to provide a capacity controlled scroll type compressor which reduces the number of component parts, thereby decreasing the manufacturing cost of the compressor. In particular, it is an object of the present invention to provide a capacity controlled scroll type compressor which operates without an electromagnetic valve, and which does not require a piston whose reciprocal movement is dependent upon a bellows disposed therein.

A scroll type compressor includes a housing having an inlet port and an outlet port, a fixed scroll fixedly disposed within the housing and having a first circular end plate from which a first spiral element extends into an interior of the housing, and an orbiting scroll having a second circular end plate from which a second spiral element extends. The first and second spiral elements interfit at an angular and radial offset forming a plurality of line contacts and defining a central fluid pocket and at least one pair of outer fluid pockets. A driving mechanism is operatively connected to the orbiting scroll to effect orbital motion thereof. A rotation preventing mechanism prevents the rotation of the orbiting scroll during orbital motion. The first circular end plate divides the interior of the housing into a front chamber and a rear chamber. The front chamber communicates with the inlet port. The rear chamber communicates with the central fluid pocket.

A variable displacement mechanism controls an opening and closing of a communication path between at least one of a pair of intermediately located fluid pockets and the front chamber. The variable displacement mechanism includes a hollow cavity with a piston member slidably retained therewithin. The hollow cavity has a plurality of fluid communication holes along the length thereof. These fluid communication holes transfer fluid at various pressures to different working surfaces of the piston, thereby causing the piston to reciprocate within the hollow cavity. The piston is spring biased in the direction of establishing a communication path between the intermediate fluid pockets and the suction chamber, but such spring biasing force is permanently counteracted by a supply of discharge pressure acting on the opposite working surface of the piston. When the communication path between the intermediate fluid pockets and the suction chamber is established, the capacity of the compressor, in accordance with the lower heat load thereon, is reduced.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF THE PREFERRED EMBODIMENT

Figure 1:
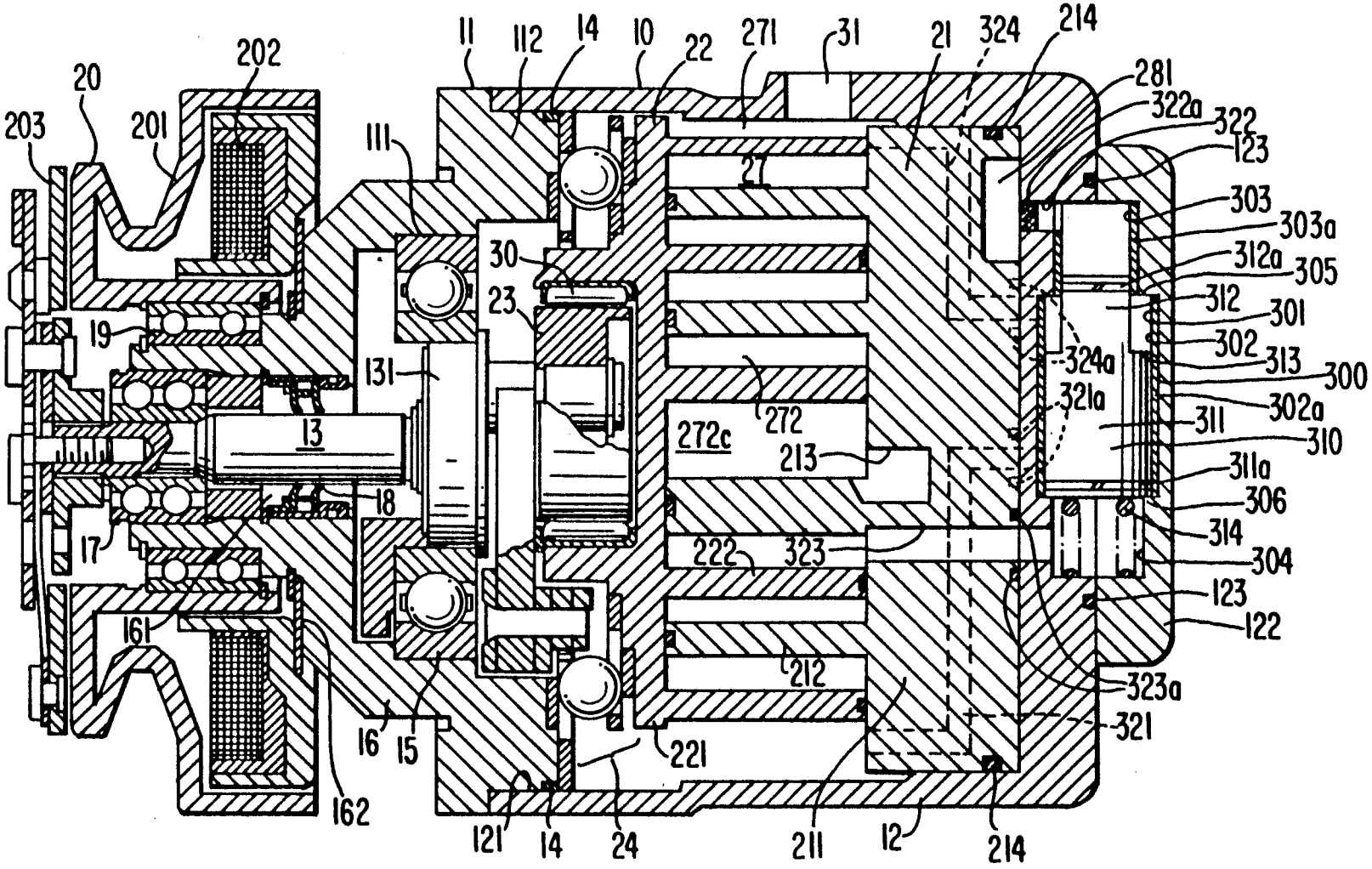
FIG. 1 illustrates a cross-sectional view of a scroll type compressor with a variable displacement mechanism in accordance with a first embodiment of the present invention.

FIG. 1 illustrates an overall construction of a scroll type compressor with a variable displacement mechanism in accordance with a first embodiment of the present invention. Referring to FIG. 1, the scroll type compressor includes compressor housing 10 having front end plate 11 and cup-shaped casing 12 which is attached to an end surface of front end plate 11. Opening 111 is formed in the center of front end plate 11 with drive shaft 13 disposed therewithin. Annular projection 112, formed on a rear surface of front end plate 11, is disposed within opening 121 of cup-shaped casing 12 and is concentric with opening 111. An outer peripheral surface of projection 112 extends along an inner wall of opening 121 of cup-shaped casing 12. Opening 121 of cup-shaped casing 12 is covered by front end plate 11. O-ring seal element 14 seals the mating surfaces between the outer peripheral surface of annular projection 112 and the inner wall of opening 121 of cup-shaped casing 12.

Annular sleeve 16, integrally formed with front end plate 11, projects from the front end surface of front end plate 11 to surround and rotatably support drive shaft 13 through bearing 17. At the inner end of drive shaft 13, disc-shaped rotor 131 is rotatably supported by front end plate 11 through bearing 15 disposed within opening 111 of front end plate 11. Shaft seal assembly 18 is coupled to drive shaft 13 within shaft seal cavity 161 of sleeve 16.

In operation, drive shaft 13 is driven by an external power source, for example, the engine of an automobile. This power is transmitted through a rotation transmitting device such as electromagnetic clutch 20 which includes pulley 201, electromagnetic coil 202, and armature plate 203. Pulley 201 is rotatably supported by ball bearing 19 carried on the outer surface of sleeve 16. Electromagnetic coil 202 is fixed about the outer surface of sleeve 16 by support plate 162. Armature plate 203 is elastically supported on the outer end of drive shaft 13.

Fixed scroll 21, orbiting scroll 22, a driving mechanism for orbiting scroll 22, and rotation preventing/thrust bearing mechanism 24 for orbiting scroll 22 are disposed in the interior of housing 10. When orbiting scroll 22 orbits, rotation is prevented by rotation preventing/thrust bearing mechanism 24 located between the inner end surface of front end plate 11 and circular end plate 221 of orbiting scroll 22. Fixed scroll 21 includes circular end plate 211 and spiral element 212 extending from one end surface of circular end plate 211. Fixed scroll 21 is fixed within the inner chamber of cup-shaped casing 12 by screws (not shown) which are screwed into circular end plate 211 from the outside of cup-shaped casing 12. Circular end plate 211 of fixed scroll 21 partitions the inner chamber of cup-shaped casing 12 into two chambers, front chamber 27 which includes suction chamber 271 and a rear chamber which includes discharge chamber 281. Spiral element 212 is located within front chamber 27. O-ring seal element 214 seals the mating surfaces between the outer peripheral surface of circular end plate 211 of fixed scroll 21 and the inner wall of cup-shaped casing 12.

Orbiting scroll 22, located in front chamber 27, includes circular end plate 221 and spiral element 222 extending from one end surface of circular end plate 221. Spiral element 222 of orbiting scroll 22 and spiral element 212 of fixed scroll 21 interfit at a predetermined radial and angular offset of 180° to form at least one pair of sealed spaces 272 between spiral elements 212 and 222. Orbiting scroll 22 is rotatably supported by bushing 23 through radial needle bearing 30. Bushing 23 is eccentrically connected to the inner end of disc-shaped rotor 131.

Compressor housing 10 has inlet port 31 and an outlet port 32 (FIG. 4) for connecting the compressor to an external refrigeration circuit. Refrigeration fluid from one component of the external refrigeration circuit, such as an evaporator, is introduced into suction chamber 271 through inlet port 31. The refrigeration fluid flows into the sealed spaces formed between spiral elements 212 and 222 when the spaces between the spiral elements sequentially open and close during the orbital motion of orbiting scroll 22. When the spaces are open, fluid flows into these spaces but no compression occurs. When the spaces are closed, no additional fluid flows into the spaces and compression begins. Since the location of the outer terminal ends of spiral elements 212 and 222 is at the final involute angle, the location of the spaces is directly related to the final involute angle. Refrigeration fluid in sealed spaces 272 is moved radially inwardly and is compressed by the orbital motion of orbiting scroll 22.

Compressed refrigeration fluid at center sealed space **272*c* is discharged to discharge chamber 281 through discharge port 213, which is formed at the center of circular end plate 211 of fixed scroll 21. Discharge port 213 is covered by a conventional one-way flap valve (not shown) which allows the compressed fluid to flow from center sealed space 272*c* to discharge chamber 281, but not in reverse. After exiting discharge chamber 281 through the outlet port 32 (FIG. 4**), the compressed refrigeration fluid flows to another element of the external air conditioning circuit, such as a condenser.

In FIG. 1, discharge chamber 281 is illustrated as a small hollow space. However, in actuality, discharge chamber 281 occupies a relatively large hollow space defined by circular end plate 211 of fixed scroll 21 and a rear portion of cup-shaped casing 12. Furthermore, although not shown in FIG. 1, it will be readily understood by those skilled in the art that discharge port 213 is linked to discharge chamber 281 by a passage or a conduit formed in circular end plate 211 of fixed scroll 21.

A generally semicylindrical-shaped member 122 is fixedly attached to an outer surface of a rear end of cup-shaped casing 12 by a plurality of screws (not shown). O-ring seal element 123 seals the mating surfaces between the outer rear end of cup-shaped casing 12 and the front surface of semicylindrical-shaped member 122.

Variable displacement mechanism 300 includes radially extending cylindrical hollow space 301 formed between the rear end of cup-shaped casing 12 and the inner forward end of semicylindrical-shaped member 122. Cylindrical hollow space 301 includes large diameter portion 302 and a pair of small diameter portions 303 and 304 which are located at upper and lower ends of large diameter portion 302, respectively. First annular ridge 305 forms a boundary between large diameter portion 302 and upper small diameter portion 303. Second annular ridge 306 forms a boundary between large diameter portion 302 and lower small diameter portion 304. Cylindrical pipe member **302*a* is fixedly disposed in large diameter portion 302 while cylindrical pipe member 303*a* is fixedly disposed in upper small diameter portion 303**.

Cylindrical valve member 310, which is essentially a piston slidably disposed within cylindrical hollow space 301, includes first section 311 and second section 312. First section 311 of cylindrical valve member 310 is slidably disposed within cylindrical pipe member **302*a*. Second section 312 of cylindrical valve member 310 is integrally formed as an upper end of first section 311, and is slidably disposed within cylindrical pipe member 303*a*. Cylindrical valve member 310 further includes annular shoulder section 313 which forms a boundary between first section 311 and second section 312**.

First and second communication paths 321 and 324, both of which link suction chamber 271 to an inner hollow space of cylindrical pipe member **302*a*, are continuously formed through circular end plate 211 of fixed scroll 21, the rear end of cup-shaped casing 12, and cylindrical pipe member 302*a*. One end of first communication path 321 opens to a lower portion of the inner hollow space of cylindrical pipe member 302*a*, while the other end thereof opens to suction chamber 271. One end of second communication path 324 opens to an upper end portion of the inner hollow space of cylindrical pipe member 302*a*, while the other end thereof opens to suction chamber 271**.

Third communication path 322, continuously formed through the rear end of cup-shaped casing 12 and cylindrical pipe member **303*a*, links discharge chamber 281 to an upper end portion of an inner hollow space of cylindrical pipe member 303*a*. Filter member 322*a* is fixedly disposed within third communication path 322. Fourth communication path 323, continuously formed through circular end plate 211 of fixed scroll 21 and the rear end of cup-shaped casing 12, links a pair of intermediately located sealed spaces to lower small diameter portion 304 of cylindrical hollow space 301. One end of fourth communication path 323 opens to lower small diameter portion 304 of cylindrical hollow space 301. The other end of fourth communication path 323** is forked into two branches (not shown) which respectively communicate with a pair of intermediately located sealed spaces.

O-ring seal elements **321*a*, 323*a* and 324*a* surrounding first, fourth, and second communication paths 321, 323 and 324, respectively, seal the mating surfaces between the rear surface of circular end plate 211 of fixed scroll 21 and the inner surface of the rear end of cup-shaped casing 12**.

Coil spring 314 is disposed between the bottom surface of lower small diameter portion 304 of cylindrical hollow space 301 and the lower end surface of first section 311 of cylindrical valve member 310. Consequently, cylindrical valve member 310 is urged upwardly by virtue of the restoring force of coil spring 314.

First piston ring **311*a* is mounted on a lower end portion of first section 311 of cylindrical valve member 310. Although there is a slight gap between the outer peripheral surface of first section 311 of cylindrical valve member 310 and the inner wall of cylindrical pipe member 302*a*, first piston ring 311*a* effectively prevents fluid communication between the inner hollow space of cylindrical pipe member 302*a* and lower small diameter portion 304 of cylindrical hollow space 301. Second piston ring 312*a* is mounted on the upper end portion of second section 312 of cylindrical valve member 310. Again, although there is a slight gap between the outer peripheral surface of second section 312 of cylindrical valve member 310 and the inner wall of cylindrical pipe member 303*a*,second piston ring 312*a* effectively prevents fluid communication between the inner hollow space of cylindrical pipe members 302*a* and 303*a***.

Figure 3:
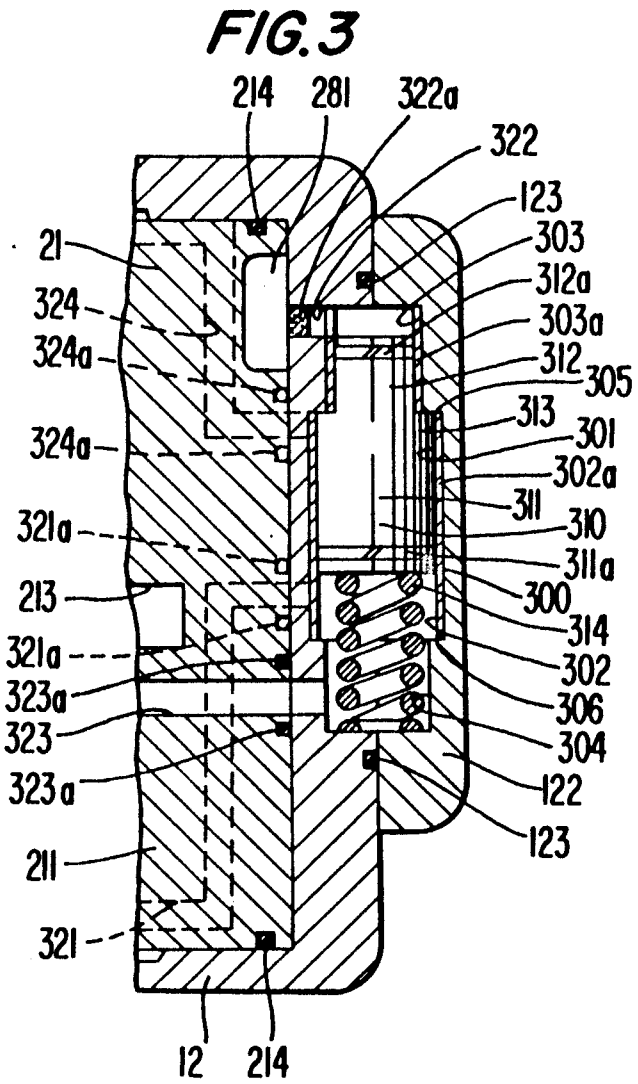
FIG. 3 illustrates a cross-sectional view of the variable displacement mechanism shown in FIG. 1, but with the piston fully extended within the hollow cavity.

The upward sliding movement of cylindrical valve member 310 within cylindrical hollow space 301 is limited by the contact between annular shoulder section 313 with first annular ridge 305. As illustrated in FIG. 3, when annular shoulder section 313 is in contact with first annular ridge 305, second section 312 of cylindrical valve member 310 is located within cylindrical pipe member **303*a*. Consequently, a fluid communication path is established between first communication path 321 and fourth communication path 323. Even when cylindrical valve member 310 is in its uppermost position as shown in FIG. 3, discharge pressure is still exclusively supplied to the upper surface of second section 312 of cylindrical valve member 310**.

Downward movement of cylindrical valve member 310 is limited by contact between the lower end of first section 311 with second annular ridge 306. As illustrated in FIG. 1, when the lower end of first section 311 is in contact with second annular ridge 306, an upper end portion of second section 312 is still located in cylindrical pipe member **303*a*. However, when cylindrical valve member 310 is positioned as shown in FIG. 1, the fluid communication path between first communication path 321 and fourth communication path 323** is blocked.

Depending upon its position, cylindrical valve member 310 is subjected to some or all of four forces F1–F4. First force F1 is generated by the discharge pressure applied to the upper end surface of second section 312 of cylindrical valve member 310. Second force F2 is generated by the suction pressure applied to annular shoulder section 313. First and second forces F1 and F2 urge cylindrical valve member 310 downwardly. Third force F3 is generated by the pressure applied to the lower end surface of first section 311 of cylindrical valve member 310. The restoring force of coil spring 314 generates fourth force F4. Third and fourth forces F3 and F4 urge cylindrical valve member 310 upwardly.

Before the compressor is started, the pressure in the pair of intermediately located sealed spaces and the pressure in discharge chamber 281 are equal. Accordingly, first, second and third forces F1–F3 cancel each other out. Therefore, since cylindrical valve member 310 receives only fourth force F4, i.e., the restoring force of coil spring 314, it is positioned as illustrated in FIG. 3. Consequently, suction chamber 271 is linked to the pair of intermediately located sealed spaces via first communication path 321, inner hollow space of cylindrical pipe member 302*a*, lower small diameter portion 304, and fourth communication path 323. Therefore, when the compressor is initially started, the compressor operates with a minimum displacement.

However, after the initial start-up, the pressure in discharge chamber 281 quickly increases while the pressure in suction chamber 271 slowly decreases. Therefore, first force F1 quickly increases while second and third forces F2 and F3 slowly decrease, and as a result, cylindrical valve member 310 moves downwardly against the restoring force of coil spring 314 until the lower end surface of first section 311 contacts second annular ridge 306 as illustrated in FIG. 1. This closes one end of first communication path 321, and consequently, the communication between suction chamber 271 and the pair of intermediately located sealed spaces is blocked. Accordingly, the compressor operates with the maximum displacement.

Figure 2:
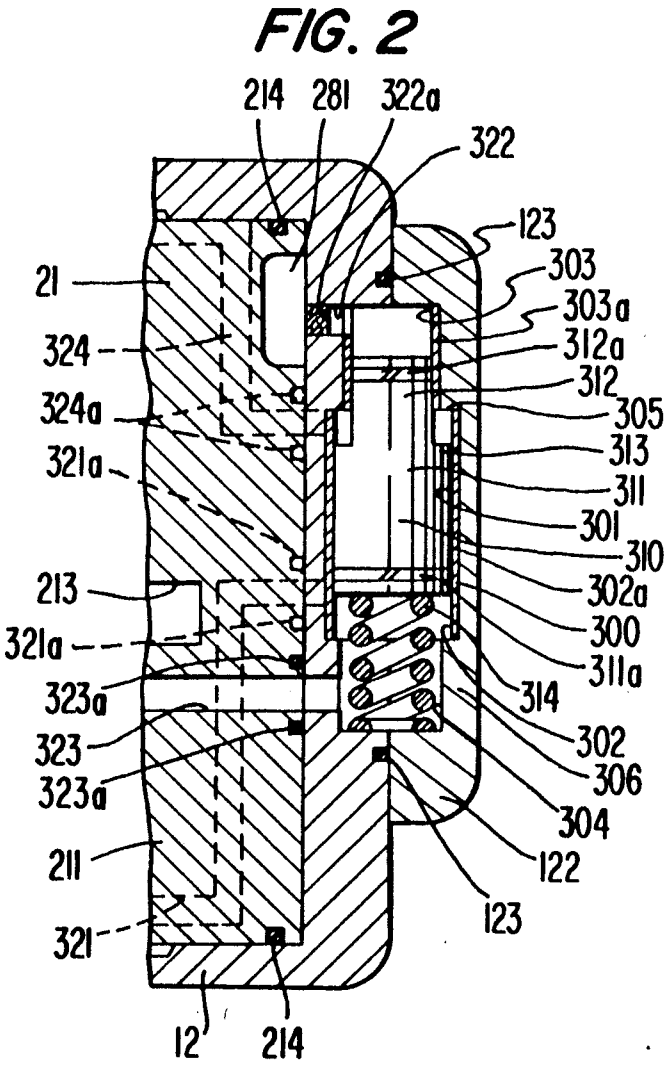
FIG. 2 illustrates a cross-sectional view of the variable displacement mechanism shown in FIG. 1, but with the piston partially extended within the hollow cavity.

When the heat load on the refrigeration circuit decreases, the pressure in both suction and discharge chambers 271 and 281 decreases. Accordingly, cylindrical valve member 310 moves upwardly by virtue of the restoring force of coil spring 314 to an intermediate location, such as that illustrated in FIG. 2. When the cylindrical valve member 310 is positioned as in FIG. 2, the sum of first and second forces F1 and F2 balances with the sum of third and fourth forces F3 and F4. At this location, one end of first communication path 321 is opened halfway by the side wall of first section 311 of cylindrical valve member 310. Consequently, a fluid communication path is established between suction chamber 271 and the pair of intermediately located sealed spaces, and the displacement of the compressor is reduced.

On the other hand, when the heat load on the refrigeration circuit increases, pressure in both suction and discharge chambers 271 and 281 increases. Accordingly, cylindrical valve member 310 moves downwardly against the restoring force of coil spring 314 to an intermediate location between that depicted in FIGS. 1 and 2. Again, an equilibrium of forces acting on cylindrical valve member 310 is achieved whereby the sum of first and second forces F1 and F2 balances with the sum of third and fourth forces F3 and F4. At this location, one end of first communication path 321 is closed by the side wall of first section 311 of cylindrical valve member 310. Thus, the communication between suction chamber 271 and the pair of intermediately located sealed spaces is blocked, and the displacement of the compressor is increased.

Thus, first section 311 of cylindrical valve member 310 opens and closes one end of first communication path 321 in response to changes in the heat load. This cyclical movement of cylindrical valve member 310 either establishes or terminates a fluid flow path between suction chamber 271 and the pair of intermediately located sealed spaces. Accordingly, depending upon the position of cylindrical valve member 310 within the cylindrical hollow space 301, the displacement of the compressor varies in response to changes in the heat load.

Furthermore, since second communication path 324 always supplies suction chamber pressure to an annular hollow space between annular shoulder section 313 and first annular ridge 305, a vacuum which would otherwise be created in the annular hollow space when cylindrical valve member 310 moves downwardly from the location as illustrated in FIG. 3 can be prevented. Therefore, first section 311 of cylindrical valve member 310 smoothly slides within cylindrical pipe member 302*a* even when cylindrical valve member 310 moves downwardly from the location as illustrated in FIG. 3.

Moreover, the responsiveness of the variable displacement mechanism 300 can be changed by appropriately selecting the spring constant of coil spring 314 or by changing the diameters of upper small diameter portion 303 and large diameter portion 302 of cylindrical hollow space 301.

The compressor disclosed in the first embodiment of the present invention operates without an electromagnetic valve, and only requires one valve to provide the variable capacity feature. Consequently, the number of component parts and resulting manufacturing cost of the variable displacement mechanism are effectively decreased.

Figure 4:
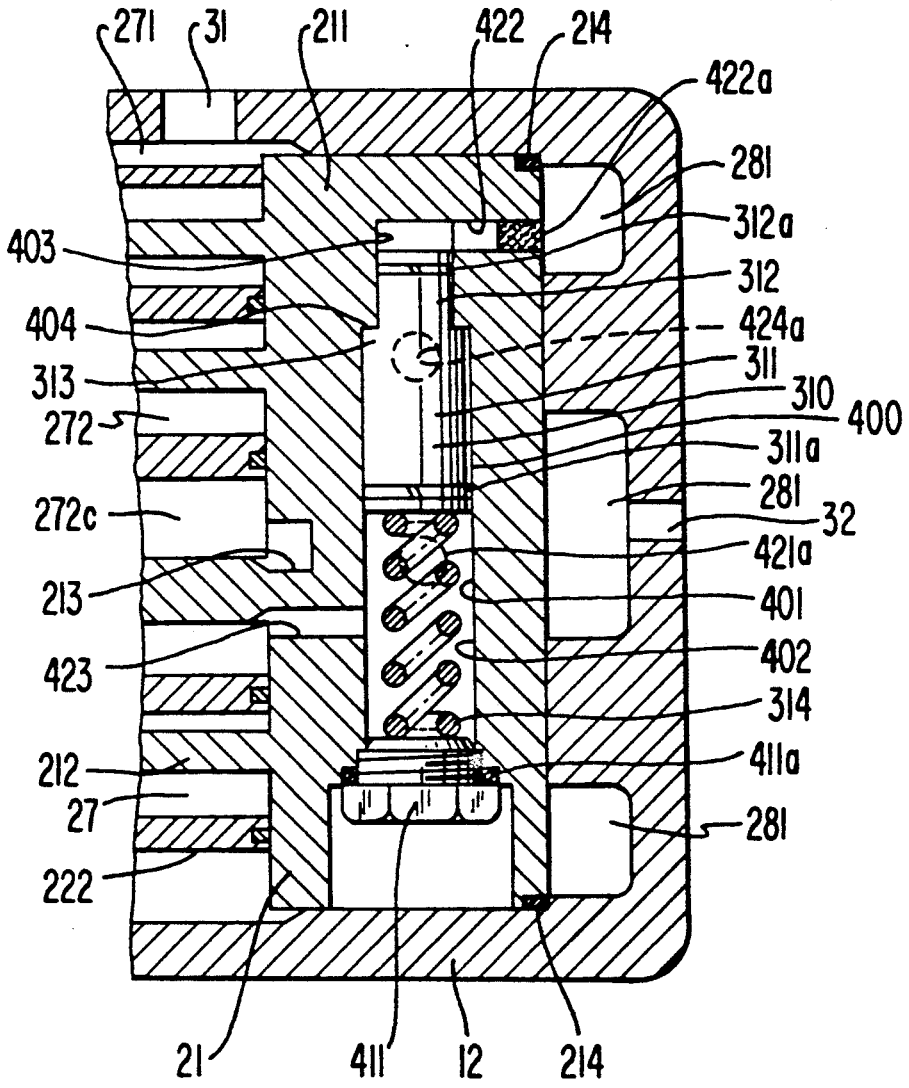
FIG. 4 illustrates a cross-sectional view of a scroll type compressor with a variable displacement mechanism in accordance with a second embodiment of the present invention.

FIG. 4 illustrates a second embodiment of the present invention in which the same reference numerals are used to denote the corresponding elements shown in FIG. 1. Referring to FIG. 4, variable displacement mechanism 400 includes radially extending cylindrical hollow space 401 formed in circular end plate 211 of fixed scroll 21 and cylindrical valve member 310 slidably disposed within cylindrical hollow space 401. Cylindrical hollow space 401 is bored from one peripheral end of circular end plate 211 of fixed scroll 21 and terminates at a position which is adjacent to an opposite peripheral end of circular end plate 211. The opening end of cylindrical hollow space 401 is sealingly plugged by plug 411 about which O-ring seal element 411*a* is disposed. Cylindrical hollow space 401 includes large diameter portion 402 and small diameter portion 403 which is located at an upper end of large diameter portion 402. Annular ridge 404 forms a boundary between large diameter portion 402 and small diameter portion 403.

Cylindrical valve member 310 includes first and second sections 311 and 312 slidably disposed within cylindrical hollow space 401. First section 311 is slidably disposed within large diameter portion 402 of cylindrical hollow space 401. Second section 312, formed integrally with an upper end of first section 311, is slidably disposed within small diameter portion 403 of cylindrical hollow space 401. Cylindrical valve member 310 further includes annular shoulder section 313 forming a boundary between first section 311 and second section 312.

A first communication path (only one end 421*a* of which is shown), formed in circular end plate 211 of fixed scroll 21, links suction chamber 271 to large diameter portion 402 of cylindrical hollow space 401. One end 421*a* of the first communication path opens at a first position to large diameter portion 402 of cylindrical hollow space 401, and the other end thereof opens to suction chamber 271. Third communication path 422, formed in circular end plate 211 of fixed scroll 21, links discharge chamber 281 to an upper end of small diameter portion 403 of cylindrical hollow space 401. Filter member 422*a* is fixedly disposed within third communication path 422.

Fourth communication path 423, formed in circular end plate 211 of fixed scroll 21, links a pair of intermediately located sealed spaces to large diameter portion 402 of cylindrical hollow space 401. One end of fourth communication path 423 opens to large diameter portion 402 of cylindrical hollow space 401 at a position which is lower than the first position of one end 421*a* of the first communication path. The other end of fourth communication path 423 is forked into two branches (not shown) which respectively communicate with a pair of intermediately located sealed spaces. A second communication path (only one end 424*a* of which is shown), formed in circular end plate 211 of fixed scroll 21, links suction chamber 271 to large diameter portion 402 of cylindrical hollow space. One end 424*a* of the second communication path opens at an upper end of large diameter portion 402 of cylindrical hollow space 401, and the other end thereof opens to suction chamber 271.

The upward sliding movement of cylindrical valve member 310 within cylindrical hollow space 401 is limited by the contact between annular shoulder section 313 with annular ridge 404. As illustrated in FIG. 4, when annular shoulder section 313 is in contact with annular ridge 404, second section 312 of cylindrical member 310 is located within small diameter portion 403 of cylindrical hollow space 401. Consequently, a fluid communication path is established between first communication path 421*a* and fourth communication path 423. Even when cylindrical valve member 310 is in its uppermost position as shown in FIG. 4, discharge pressure is still exclusively supplied to the upper surface of second section 312. By appropriately designing spring constant of coil spring 314, downward movement of cylindrical valve member 310 is limited to maintain second section 312 of cylindrical member 310 within small diameter portion 403 of cylindrical hollow space 401.

In the second embodiment, the functional operation of the variable displacement mechanism 400 is similar to the functional operation of the variable displacement mechanism 300 described in the first embodiment. Accordingly, explanation thereof is omitted.

The present invention has been described in detail in connection with the preferred embodiments. These embodiments, however, are merely for explanation only and the invention is not restricted thereto. It will be understood by those skilled in the art that other variations and modifications can easily be made within the scope of the invention as defined by the appended claims.

We claim:

1. In a scroll type fluid displacement apparatus including a housing having an inlet port and an outlet port, a fixed scroll disposed within said housing and having a first circular end plate from which a first spiral element extends into an interior of said housing, an orbiting scroll having a second circular end plate from which a second spiral element extends, said first and second spiral elements interfitting at an angular and radial offset forming a central fluid pocket and at least one pair of outer fluid pockets within the interior of said housing, a driving mechanism operatively connected to said orbiting scroll to effect orbital motion of said orbiting scroll, rotation prevention means for preventing the rotation of said orbiting scroll during orbital motion, said first circular end plate dividing the interior of said housing into a front chamber and a rear chamber, said front chamber communicating with said inlet port, said rear chamber communicating with the central fluid pocket, variable displacement means for varying the displacement of said compressor, said variable displacement means opening and closing a fluid communication path linking at least one of a pair of intermediate fluid pockets with a space having a lower pressure than said at least one pair of intermediate fluid pockets, the improvement comprising:

a cavity within said variable displacement means; and valve means, slidably disposed within said cavity, for selectively opening and closing said fluid communication path, said valve means reciprocating in said cavity between an upper position and a lower position and dividing said cavity into an upper cavity portion and a lower cavity portion, said lower cavity portion linking said fluid communication path when said valve means reciprocates to said upper position, said upper cavity portion containing solely discharge pressure even when said fluid communication path between said space and said at least one pair of intermediate fluid pockets is established.

2. The scroll type compressor of claim 1, said cavity formed in said housing.

3. The scroll type compressor of claim 1, said cavity formed in said first circular end plate.

4. The scroll type compressor of claim 1, said variable displacement means further including an elastic means, disposed within said lower cavity portion, for upwardly biasing said valve means against the opposing discharge pressure in said upper cavity portion.

5. The scroll type compressor of claim 4 wherein said elastic means is a coil spring.

6. The scroll type compressor of claim 1, said cavity comprising a large diameter cavity portion, a lower small diameter cavity portion below said large diameter cavity portion, and an upper small diameter cavity portion above said large diameter cavity portion.

7. The scroll type compressor of claim 6, said at least one pair of intermediate fluid pockets opening into said lower small diameter cavity portion.

8. The scroll type compressor of claim 6, said variable displacement means further including an elastic means, disposed within said lower small diameter cavity portion, for upwardly biasing said valve means against the opposing discharge pressure in said upper cavity portion.

9. The scroll type compressor of claim 6 wherein said variable displacement means further comprises a first communication path extending from said front chamber and opening into said large diameter cavity portion, said first communication path selectively closed and opened by the reciprocation of said valve means, said space communicating with said intermediate fluid pockets when said valve means opens said first communication path.

10. The scroll type compressor of claim 6, said variable displacement means further comprising a first annular ridge forming a boundary between said large diameter cavity portion and said upper small diameter cavity portion, and a second annular ridge forming a boundary between said large diameter cavity portion and said lower small diameter cavity portion.

11. The scroll type compressor of claim 10, said valve means comprising a first section having a large diameter portion slidably disposed within said large diameter cavity portion and a second section of smaller diameter attached to the top of said first section, said second section extending into said upper small diameter cavity portion.

12. The scroll type compressor of claim 11, said valve means having an annular shoulder forming a boundary between said first large diameter section and said second small diameter section.

13. The scroll type compressor of claim 12, said variable displacement means further comprising a second communication path extending from said front chamber and opening into said large diameter cavity portion, said second communication path selectively closed and opened by the reciprocation of said valve means and providing suction pressure to a space between said first annular ridge and said annular shoulder when said valve means reciprocates downwardly.

14. The scroll type compressor of claim 12 wherein the upper limit of reciprocation of said valve means is achieved when said annular shoulder abuts said first annular ridge, and wherein the lower limit of reciprocation of said valve means is achieved when said first section abuts said second annular ridge.

15. The scroll type compressor of claim 1 wherein said variable displacement means further comprises a first communication path extending from said front chamber and opening into said lower cavity portion, said first communication path selectively closed and opened by the reciprocation of said valve means, said space communicating with said intermediate fluid pockets when said valve means opens said first communication path.

16. The scroll type compressor of claim 1, said cavity comprising a large diameter cavity portion and a small diameter cavity portion.

17. The scroll type compressor of claim 16, said at least one pair of intermediate fluid pockets opening into said large diameter cavity portion.

18. The scroll type compressor of claim 16, said variable displacement means further including an elastic means, disposed within said large diameter cavity portion, for upwardly biasing said valve means against the opposing discharge pressure in said upper cavity portion.

19. The scroll type compressor of claim 16 wherein said variable displacement means further comprises a first communication path extending from said front chamber and opening into said large diameter cavity portion, said first communication path selectively closed and opened by the reciprocation of said valve means, said space communicating with said intermediate fluid pockets when said valve means opens said first communication path.

20. The scroll type compressor of claim 16, said variable displacement means further comprising an annular ridge forming a boundary between said large diameter cavity portion and said small diameter cavity portion, and a plug disposed in said large diameter cavity portion.

21. The scroll type compressor of claim 20, said valve means comprising a first section having a large diameter portion slidably disposed within said large diameter cavity portion and a second section of smaller diameter attached to the top of said first section, said second section extending into said small diameter cavity portion, said valve means having an annular shoulder forming a boundary between said first large diameter section and said second small diameter section, wherein the upper limit of reciprocation of said valve means is achieved when said annular shoulder abuts said annular ridge, and wherein the lower limit of reciprocation of said valve means is achieved when said first section abuts said plug.

22. A scroll type compressor comprising:

a housing having an inlet port and an outlet port;

a fixed scroll disposed within said housing and having a first circular end plate from which a first spiral element extends into an interior of said housing;

an orbiting scroll having a second circular end plate from which a second spiral element extends;

said first and second spiral elements interfitting at an angular and radial offset forming a central fluid pocket and at least one pair of outer fluid pockets within the interior of said housing, said circular end plate dividing the interior of said housing into a front chamber and a rear chamber, said front chamber communicating with said inlet port, said rear chamber communicating with the central fluid pocket;

driving mechanism operatively connected to said orbiting scroll to effect orbital motion of said orbiting scroll;

rotation prevention means for preventing the rotation of said orbiting scroll during orbital motion;

variable displacement means for varying the displacement of said compressor, said variable displacement means opening and closing a fluid communication path linking at least one pair of intermediate fluid pockets with a space having a lower pressure than said at least one pair of intermediate fluid pockets;

a cavity within said variable displacement means;

a plurality of fluid communication paths opening into said cavity; and valve means, slidably disposed within said cavity, for selectively covering and uncovering at least some of said fluid communication passages, said valve means biased at the top and bottom thereof causing said valve means to reciprocate in said cavity between an upper position and a lower position;

said communication path between said at least one pair of intermediate fluid pockets and said space established when said valve control means reciprocates to said upper position, said valve means continuously exposed at the top thereof solely to discharge pressure even when said fluid communication path between said at least one pair of intermediate fluid pockets and said space is established.

23. The scroll type compressor of claim 22 wherein said cavity is formed in said housing.

24. The scroll type compressor of claim 22 wherein said cavity is formed in said first circular end plate.

25. A scroll type compressor comprising:

a housing having an inlet port and an outlet port;

a fixed scroll disposed within said housing and having a first circular end plate from which a first spiral element extends into an interior of said housing;

an orbiting scroll having a second circular end plate from which a second spiral element extends;

said first and second spiral elements interfitting at an angular and radial offset forming a central fluid pocket and at least one pair of outer fluid pockets within the interior of said housing, said first circular end plate dividing the interior of said housing into a front chamber and a rear chamber, said front chamber communicating with said inlet port, said rear chamber communicating with the central fluid pocket;

driving mechanism operatively connected to said orbiting scroll to effect orbital motion of said orbiting scroll;

rotation prevention means for preventing the rotation of said orbiting scroll during orbital motion;

variable displacement means for varying the displacement of said compressor, said variable displacement means opening and closing a fluid communication path linking at least one pair of intermediate fluid pockets with a space having a lower pressure than said at least one pair of intermediate fluid pockets;

a cavity within said variable displacement means; and valve means, slidably disposed within said cavity, for selectively covering and uncovering said fluid communication path, said valve means dividing said cavity into an upper cavity portion and a lower cavity portion;

wherein when said fluid communication path is blocked, said upper cavity portion contains discharge pressure, and when said fluid communication path is established, said upper cavity portion still contains discharge pressure.

* * * * *